United States Patent [19]

Speed

[11] Patent Number: 4,462,758

[45] Date of Patent: Jul. 31, 1984

[54] WATER WELL PUMP CONTROL ASSEMBLY

[75] Inventor: Russell H. Speed, Fort Wayne, Ind.

[73] Assignee: Franklin Electric Co., Inc., Bluffton, Ind.

[21] Appl. No.: 457,423

[22] Filed: Jan. 12, 1983

[51] Int. Cl.[3] ..... F04B 49/08

[52] U.S. Cl. ..... 417/38; 200/83 R; 361/395; 361/399

[58] Field of Search ..... 417/36-40, 417/63, 44; 361/395, 399; 200/83 R

[56] References Cited

U.S. PATENT DOCUMENTS

| | | | |
|---|---|---|---|
| 3,270,251 | 8/1966 | Evans | 361/395 X |
| 3,794,789 | 2/1974 | Bynum | 417/38 X |
| 3,805,117 | 4/1974 | Hausman | 361/395 |
| 4,171,932 | 10/1979 | Miller | 417/36 |

*Primary Examiner*—Edward K. Look

*Attorney, Agent, or Firm*—Marshall, O'Toole, Gerstein, Murray & Bicknell

[57] ABSTRACT

This disclosure relates to a control assembly, a well pumping system, the system including an electric motor driven pump and a storage tank that receives liquid from the pump. The control assembly includes a mounting plate, a pressure switch that responds to the pressure of the liquid in the tank, the pressure switch being mounted on the plate, a terminal board and a printed circuit board. The terminal board is mounted on the plate adjacent the pressure switch, and power leads are secured to connectors on the pressure switch and on the terminal board. The printed circuit board includes a start winding control switch for the electric motor, and mating quick connect terminals on the terminal and printed circuit boards connect the start winding control switch with the motor. When the motor is a capacitor-start type, a capacitor is connected in the control switch by quick connect terminals, these terminals further serving to support the capacitor on the two boards and the mounting plate. A cover encloses the pressure switch, the two boards and, when one is provided, the capacitor.

12 Claims, 11 Drawing Figures

WATER WELL PUMP CONTROL ASSEMBLY

This invention relates to a control assembly for a well pumping system such as a water well for a rural residence. Conventional well pumping systems of this nature include an electric motor driven pump installed in the well, the pump being connected by pipes to a water storage tank which in turn is connected to the water distribution system of the residence. A typical prior art control has included a pressure switch that is connected to the pipes and responds to the water pressure in the storage tank, and the switch turns the motor on and off to maintain the water pressure in the tank within a preset pressure range. The electric motor is usually a single phase type, and the control further includes a start winding control switch along with, in the case of a capacitor start motor, a capacitor.

Prior art controls of the foregoing nature have been deficient in that the parts of the control have been dispersed or separated. The pressure switch has been in one housing and the motor start winding control switch and the capacitor have been in a separate housing which is often displaced from the pressure switch housing. This arrangement has a number of disadvantages including the fact that numerous electrical connections have to be made when the control is installed. Separate control installations further require excessive space and number of parts.

It is a general object of the present invention to provide an improved control assembly that avoids the foregoing disadvantages.

A control assembly in accordance with this invention comprises a mounting plate, a pressure switch fastened to said plate, a terminal board fastened to said plate adjacent said pressure switch, said pressure switch and said terminal board having electrical connectors thereon for connection to power lines, a printed circuit board having a motor start winding control switch thereon, said terminal board and said printed circuit board further having mating quick connect terminals thereon for connecting said start winding control switch to said power lines and said motor, and a cover enclosing said pressure switch, said terminal board and said printed circuit board.

The assembly may further include a capacitor for use of the assembly with a capacitor-start motor, the capacitor and the printed circuit board having mating quick connect terminals for connecting said capacitor in said start winding control switch. The capacitor further includes a casing that encloses the printed circuit board and preferably engages the terminal board. When a capacitor is included in the assembly, the cover also encloses the capacitor.

The foregoing and other objects and advantages of the invention will become more apparent from the following detailed description taken in conjunction with the accompanying figures of the drawings, wherein.

Figure 1:
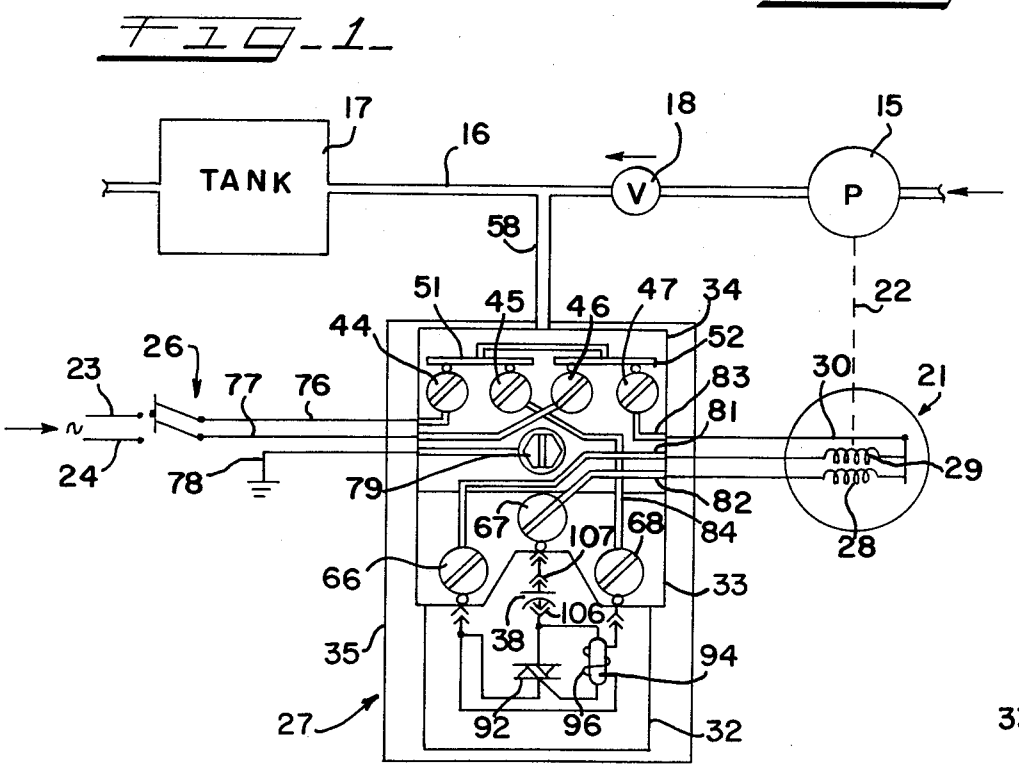
FIG. 1 is a schematic diagram of a well pumping system including a control assembly in accordance with the present invention.

The system shown in FIG. 1 includes a pump 15 for pumping a liquid such as water from a residential water well through a pipe 16 to a storage tank 17. A one-way check valve 18 is connected in the pipe 16 for preventing the reverse flow of water from the tank 17 to the pump 15. Residential water well pumping systems including such a pump, valve and storage tank are well known and do not require further description. The pump 15 is powered by a single phase electric motor 21 which has its rotor fastened by a coupling 22 to the impeller of the pump 15. The motor 21 is connected to a single phase AC power supply lines 23 and 24 by a conventional contactor 26 and a control assembly 27 constructed in accordance with this invention. The power lines 23 and 24 may be connected to her 115 volts or 230 volts power supply, and in the present specific example, the system is connected to a 115 volts supply.

The motor 21 in this example is a capacitor-start single phase induction motor having a conventional construction. The motor is preferably a submersible type that is coupled to the pump 15 and is suspended in the well along with the pump. The motor 21 includes a start winding 28, a main or run winding 29, and a common lead 30, which are mounted on the motor in the conventional manner in order to turn the rotor when the windings are energized.

Figure 2:
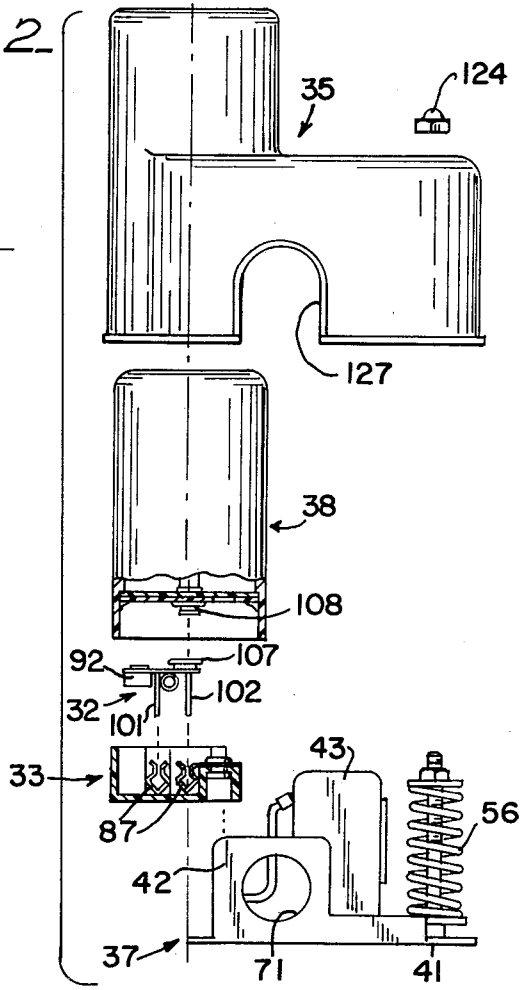
FIG. 2 is an exploded view illustrating the control assembly.

The control assembly 27, constructed in accordance with this invention, includes a printed circuit board 32, a terminal board 33, a pressure switch 34, and a housing or enclosure 35. With reference to FIG. 2, the assembly further includes a mounting plate 37 on which the other components are fastened, and in the instance where the motor is a capacitor-start type, the assembly still further includes a start capacitor 38.

Figure 8:
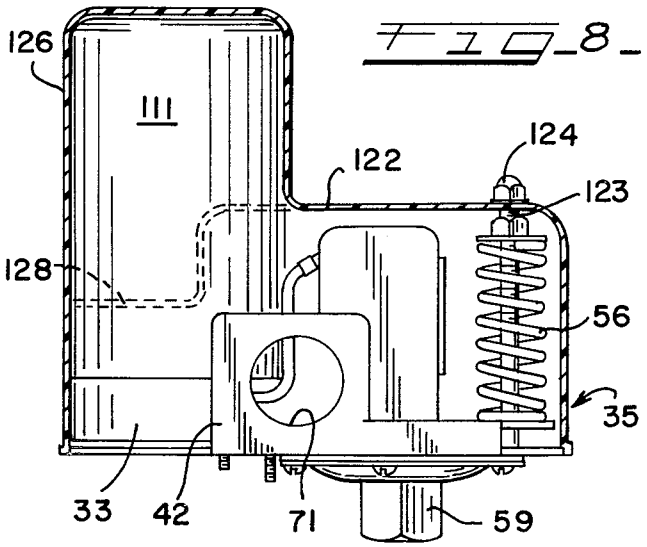
FIG. 8 is a view partially in section of the assembly.
Figure 10:
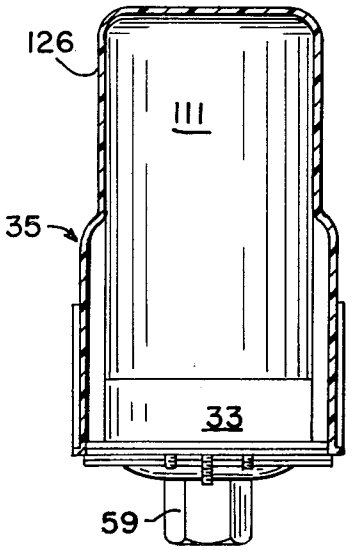
FIG. 10 is a sectional view of one side of the assembly.
Figure 11:
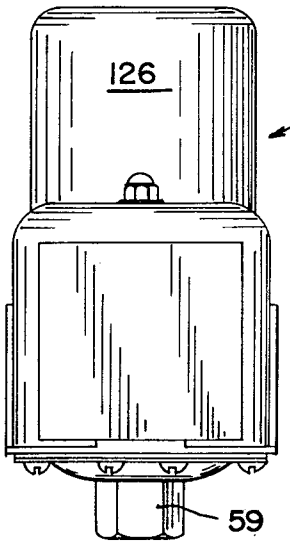
FIG. 11 is an elevational view of the other end of the assembly.

The pressure switch 34 and the mounting plate 37 may have a conventional construction. For example, the pressure switch and plate 37 may be of the type shown in U.S. Pat. No. 3,340,372, which is manufactured by Square D Company and marketed as their product No. FSG-2 pressure switch. The mounting plate 37 includes a relatively flat bottom wall 41 and upturned side walls 42 (FIGS. 2 and 8). An insulator 43 is secured to the plate 37 and supports screw-type connectors 44–47 shown in FIG. 3. A switch or breaker mechanism 49 is mounted on the plate 37 and on the insulator 43 and, in response to the pressure in the pipe 16, either makes or breaks electrical connections between the terminals 44 and 45 and between the terminals 46 and 47. The breaker 49 includes a bar 51 that is adapted to connect with the terminals 44 and 45 and it includes another bar 52 that is adapted to make a connection between the terminals 46 and 47. The pressure switch 34 further includes a pressure responsive mechanism indicated generally at 53 (FIG. 3) which moves the bars 51 and 52 into electrical engagement with the terminals 44–47 when the tank 17 pressure is at a preset low value, and the mechanism 53 opens these connections when tank pressure is at a preset high value. When the electrical connections are made, the motor 21 is energized in order to drive the pump and force additional water into the storage tank 17. When the higher pressure value is reached, the electrical connections are broken and the motor is deenergized. The mechanism 53 includes an adjustable spring 56 for adjusting the low pressure turn on value and another spring 57 for adjusting the high pressure cut-out value. A pipe or tube 58, shown in FIG. 1, connects the pipe 16 with the pressure responsive mechanism 53. With reference to FIGS. 8, 10 and 11, a coupling 59 is provided to connect the pipe 58 to the pressure switch.

Figure 4:
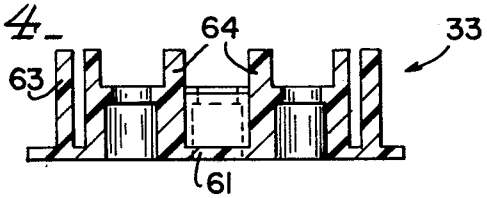
FIGS. 4 and 5 are sectional views of a terminal board of the assembly.
Figure 5:
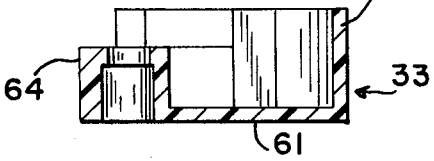
Figure 3:
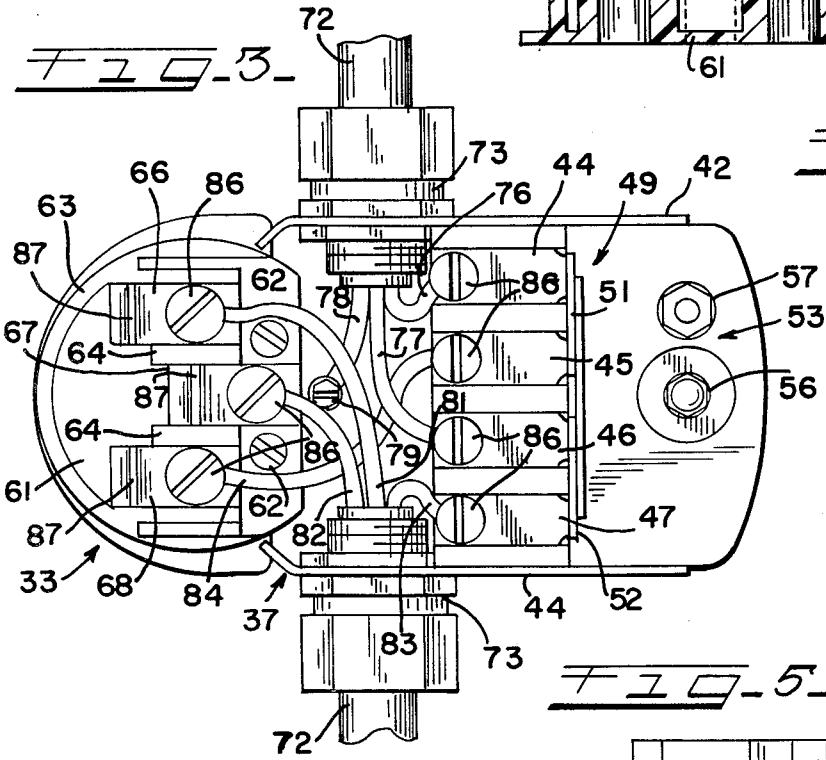
FIG. 3 is an enlarged plan view of parts of the assembly.
Figure 9:
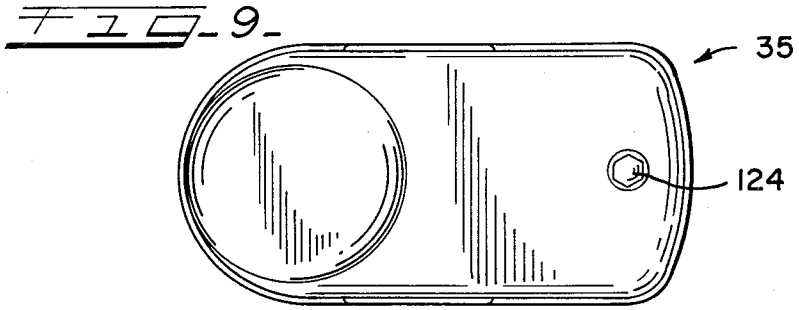
FIG. 9 is a plan view of the assembly.

The terminal board 33 comprises a flat base 61 (see FIGS. 3–5) that is positioned on one end of the mounting plate 37 and fastened to the mounting plate as by screws 62. A semi circular wall 63 extends upwardly from adjacent the outer edge of the base 61 and has a diameter that is substantially equal to the distance between the two side walls 42 of the mounting plate 37. As shown in FIG. 3, the base 61 and the wall 63 thus form a continuation of the mounting plate 37. The terminal board 33 further includes three steps or ledges 64 (best shown in FIGS. 4 and 5) which support three screw-type electrical connectors 66, 67 and 68 which are fastened to the ledges by screws 86. The various portions of the terminal board, excluding the connectors 66–68, are made of an insulating material and may be formed by molding a plastic material to the shape described and shown in the drawings.

As best shown in FIGS. 2 and 8, the two side walls 42 of the mounting plate 37 have holes 71 formed therein, and the power leads extending to the power supply and to the motor 21 extend through the holes 71. The leads include outer insulating sheaths or covers 72 (see FIG. 3) and the leads are fastened to the side walls 42 by metal couplings 73.

The lead extending to the power supply includes conductors 76 and 77 which are fastened to the connectors 44 and 46 of the breaker mechanism 49. The lead further includes a conductor 78 that is connected to ground and to the mounting plate 37, which is preferably made of metal, by a screw fastener 79. With regard to the lead extending to the motor 21, it includes a conductor 81 fastened to the connector 66, another conductor 82 fastened to a connector 67, and a third conductor 83 fastened to the terminal 47 of the pressure sensitive switch. The third connector 68 of the terminal board is fastened by a jumper 84 to the connector 45. All of the foregoing connections of the conductors are performed by screw fasteners 86. The three connectors 66, 67 and 68 further include spade receptacles 87, the construction of which is better shown in FIG. 2.

The printed circuit board 32 includes a flat circuit board 91 (see FIGS. 2, 6 and 7) which has a start winding control switch mounted thereon for the motor 21. The control switch for the start winding 28 preferably has a construction of one of the types described in Streater U.S. Pat. No. 4,307,327. Briefly, a control switch of the character described in the Streater patent includes a triac 92 (FIGS. 1, 6 and 7) and the capacitor 38 which are connected in series with the start winding 28 during low speed operation of the motor. The contacts 94 of a reed switch are connected to trigger the triac 92, and the coil 96 of the reed switch is connected in the power line leading to the main winding 29 and to the start winding 28 of the motor. As described in detail in the above-mentioned patent, during low speed operation of the motor, the main and start winding currents flow through the coil 96, the reed switch triggers the triac 92 to conduction and current flows through the capacitor 38 and the start winding 28.

Figure 6:
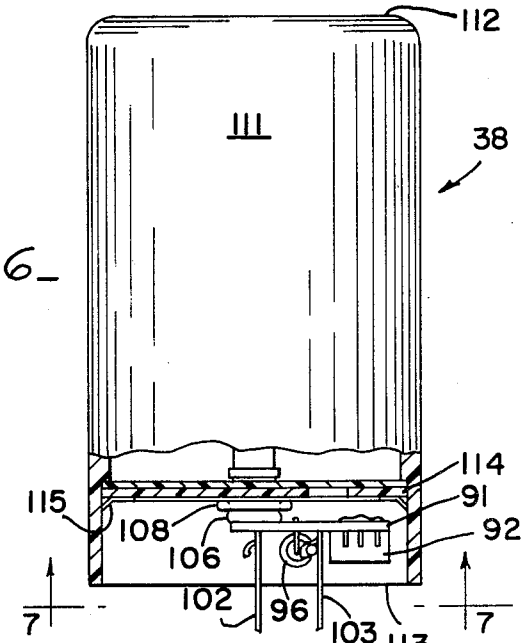
FIG. 6 is a view partially in section of a capacitor and printed circuit board of the assembly.
Figure 7:
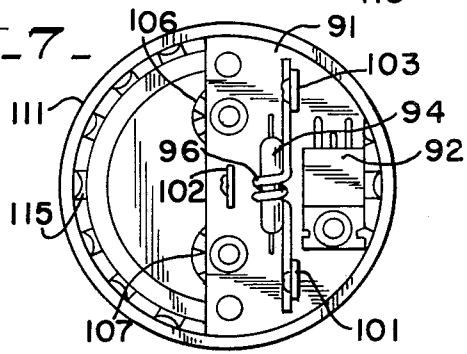
FIG. 7 is a view taken on the line 7—7 of FIG. 6.

As best shown in FIGS. 6 and 7, the triac 92 and the reed switch are mounted on one side of the board 91 and three spade terminals 101, 102 and 103 extend outwardly from the board 91. The three terminals 101–103 are designed to be coupled with the three spade receptacles 87 of the terminal board 33, thus forming a quick connect terminal arrangement. FIG. 2 illustrates the alignment of the spade terminals and the receptacles 87. Of course, when the spade terminals 101–103 are pressed into the receptacles 87, the components of the start winding control circuit are connected to the wires 81, 82 and 84 and into the remainder of the electrical system of the motor.

As is best illustrated in FIGS. 2 and 6, the spade terminals 101–103 are located on one side of the printed circuit board 91, and when a start capacitor is provided, two snap-type electrical connectors 106 and 107 are mounted on the other side of the board. The snap connectors 106 and 107 are connected in the start winding control circuit and are arranged to mate with terminal receptacles 108 of the capacitor 38.

The capacitor 38 includes a generally cylindrical case 111 (FIGS. 6 and 7) having an upper closed end 112 and a lower open end 113. An internal wall 114 is located within the open end 113 of the capacitor and held therein by a retaining ring 115. The terminals 108 are mounted on the wall 114 and are in the appropriate positions to mate with the terminals 106 and 107 of the printed circuit board when the board is pressed against the wall 114. As is best illustrated in FIGS. 6 and 7, the outer dimension of the board 91 is slightly less than the internal dimension of the case 111, thereby permitting the printed circuit board to be pressed into the open end of the case 111. The case is extended beyond the wall 114 to form a space between the wall and the end of the case, and the printed circuit board is mounted within this space by fastening the connectors 106–108. This arrangement, of course, has the advantage that the printed circuit board is protected by the extended case of the capacitor.

The outer ends of the three spade terminals 101–103, however, extend beyond the end of the case 111 as shown in FIG. 6, thereby enabling the spades to make electrical engagement with the receptacles 87, as previously described. When the printed circuit board is assembled with the capacitor 38, the assembly of the board and the capacitor may be readily mounted on the terminal board 33 by pressing the spades into the spade receptacles. As shown in FIGS. 8 and 10, the outer dimension of the case 111 is substantially the same as the outer dimension of the wall 63 of the terminal board, and when the spades are fully assembled with the receptacles 87, the open end of the case 111 engages the upper edge of the wall 63. This arrangement has the advantage of completely enclosing the printed circuit board between the capacitor and the terminal board, and the engagement of the casing 111 with the wall 63 prevents excessive pressure from being applied on the quick connect terminals, this engagement thus forming a stop.

The control assembly further includes the housing or cover 35 (FIGS. 2 and 8–11). The cover 35 includes a first portion 122 that encloses the pressure sensitive switch mechanism, the outer periphery of the cover 35 substantially conforming to the outer periphery of the mounting plate 37. The pressure adjusting mechanism 56 includes an upwardly extending screw 123 which is located in a hole formed in the portion 122 of the cover 35, and a cap screw 124 threaded on the screw 123 serves to fasten the cover 35 to the mounting plate 37. At the opposite end of the assembly, the cover 35 includes an upwardly extended portion 126 that surrounds the capacitor case 111 and the terminal board 33. The outer periphery of the portion 126 conforms to the outer periphery of the capacitor 38 and the terminal board, as is best shown in FIGS. 8 and 10. With reference to FIG. 2, cut-outs 127 are formed on opposite sides of the cover 35 which are aligned with the holes 71 formed in the mounting plate, the cutouts 127 being sufficiently large that they receive the couplings 73.

In the event the motor 21 is a split-phase induction type, the capacitor 38, of course, is not required. In this event, the circuit board 32 contains a start winding control switch of the type shown in the foregoing Streater patent which does not include a start capacitor. In the absence of a capacitor, the cover 35, in the area adjacent the terminal board 33, may have the general shape indicated by the dashed lines 128 shown in FIG. 8.

I claim:

1. A control assembly for a well pump system, the system including a single phase motor for driving the pump, a storage tank for receiving a liquid from the pump, and power leads extending to the motor and to an AC power supply, said assembly comprising mounting means, a pressure responsive electrical switch adapted to be coupled to the tank and to operate in response to the pressure in the tank, said pressure responsive electrical switch being fastened to said mounting means, a terminal board fastened to said mounting means, said pressure responsive electrical switch and said terminal board having electrical connectors thereon adapted to be connected to the power leads and thereby be connected to the motor and to the power supply, a printed circuit board having a start winding control switch thereon, mating quick connect terminals on said terminal board and on said printed circuit board, said quick connect terminals being connected to said start winding control switch and to said electrical connectors for connecting said start winding control switch to the motor, and a cover enclosing said terminal board and said printed circuit board and said pressure responsive electrical switch.

2. An assembly according to claim 1, wherein said motor is a capacitor-start motor, and further including a start capacitor, said printed circuit board and said capacitor having mating quick connect terminals thereon for connecting said capacitor to said start winding control switch.

3. An assembly according to claim 2, wherein said first mentioned quick connect terminals are on one side of said printed circuit board and said second mentioned quick connect terminals are on the opposite side of said printed circuit board.

4. An assembly according to claim 2, wherein said capacitor includes an outer case having an open end, an end wall positioned within said case and separated from said end by a space, said second mentioned quick connect terminals being on said end wall, and said printed circuit board being substantially in said space.

5. An assembly according to claim 4, wherein said terminal board includes a base and a substantially semicircular side wall, and said open end of said capacitor case abuts said side wall of said terminal board, whereby said printed circuit board is enclosed in said space between said capacitor casing and said terminal board.

6. An assembly according to claim 2, wherein said cover includes an extended portion that encloses said capacitor.

7. An assembly according to claim 1, wherein said pressure responsive electrical switch is substantially adjacent one end of said mounting means and said terminal board is substantially adjacent the other end of said mounting means, said terminal board having substantially the same width as said mounting means and generally forming a continuation of said mounting means.

8. An assembly according to claim 5, wherein said side wall of said terminal board has a diameter that is substantially equal to the diameter of said capacitor.

9. An assembly according to claim 6, wherein said cover closely encloses said capacitor and said terminal board and holds said capacitor assembled with said terminal board.

10. Apparatus for a well pump system, the system including a single phase motor for driving the pump, a storage tank for receiving a liquid from the pump, power leads extending to the motor and to an AC power supply, mounting means, a pressure responsive electrical switch adapted to be coupled to the tank and to operate in response to the pressure in the tank, said pressure responsive electrical switch being fastened to said mounting means, a terminal board fastened to said mounting means, said pressure responsive electrical switch and said terminal board having electrical connectors thereon adapted to be connected to the power leads and thereby be connected to the motor and to the power supply, a printed circuit board having a start winding control switch thereon, and terminals connecting said start winding control switch to said electrical connectors for connecting said start winding control switch to the motor, said apparatus comprising a cover adapted to enclose said terminal and printed circuit boards and said pressure responsive electrical switch, said cover further being adapted to be operatively attached to said mounting means.

11. Apparatus according to claim 10, wherein said system further includes a capacitor fastened to the printed circuit board, and wherein said cover includes an enlarged portion that is adapted to enclose the capacitor.

12. Apparatus according to claim 11, wherein said enlarged portion has a relatively close fit with the capacitor and the terminal board.

* * * * *